US008374519B2

(12) United States Patent
Motoyama

(10) Patent No.: US 8,374,519 B2
(45) Date of Patent: Feb. 12, 2013

(54) IMAGE HEATING APPARATUS CONTROLLING THE INCLINATION OF A STRETCHING MEMBER STRETCHING A BELT MEMBER

(75) Inventor: Eiichi Motoyama, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 377 days.

(21) Appl. No.: 12/485,628

(22) Filed: Jun. 16, 2009

(65) Prior Publication Data

US 2009/0317115 A1 Dec. 24, 2009

(30) Foreign Application Priority Data

Jun. 17, 2008 (JP) ..... 2008-157559

(51) Int. Cl.
*G03G 15/20* (2006.01)

(52) U.S. Cl. ..... 399/45

(58) Field of Classification Search ..... 399/45, 399/320, 68, 329
See application file for complete search history.

(56) References Cited

U.S. PATENT DOCUMENTS

| | | | | |
|---|---|---|---|---|
| 7,430,394 | B2 | 9/2008 | Fujimori et al. | 399/329 |
| 2008/0003029 | A1* | 1/2008 | Fujimori et al. | 399/329 |
| 2008/0317526 | A1 | 12/2008 | Fujimori et al. | 399/329 |

FOREIGN PATENT DOCUMENTS

| | | |
|---|---|---|
| JP | 5-27622 | 2/1993 |
| JP | 10-203674 | 8/1998 |
| JP | 10-231041 | 9/1998 |
| JP | 2004-341346 | 12/2004 |
| JP | 2008-33227 | 2/2008 |

OTHER PUBLICATIONS

Computer translation of JP10-203674A to Takayasu et al., Aug. 1998.*

* cited by examiner

*Primary Examiner* — Quana M Grainger
(74) *Attorney, Agent, or Firm* — Fitzpatrick, Cella, Harper & Scinto

(57) ABSTRACT

An image heating apparatus heats an image on a recording material and includes: a rotatable belt; a pressor contacting the belt to nip and feed the recording material; a stretcher stretching the belt; a detector detecting a position of the belt perpendicular to a rotational direction of the belt; an executor executing a first control mode for controlling a position of the belt by inclination of the stretcher on the basis of an output of the detector, and a second control mode for controlling the position of the belt member by inclination of the stretcher on the basis of the output of the detector and for stabilizing the position of the belt; an inputter inputting information relating to the recording material; and a selector for selecting the first control mode or the second control mode in accordance with the information inputted to the inputter.

15 Claims, 13 Drawing Sheets

801 802 803

| SL2 | SL1 | SR1 | SR2 | AMOUNT OF STEERING(No.OF PULSES) | POSITION LAVEL |
|---|---|---|---|---|---|
| 0 | 0 | 0 | 0 | $\alpha$ | CT |
| 0 | 1 | 0 | 0 | 100 | L1 |
| 1 | 1 | 0 | 0 | 200 | L2 |
| 0 | 0 | 1 | 0 | -100 | R1 |
| 0 | 0 | 1 | 1 | -200 | R2 |

IMAGE HEATING APPARATUS CONTROLLING THE INCLINATION OF A STRETCHING MEMBER STRETCHING A BELT MEMBER

FIELD OF THE INVENTION AND RELATED ART

The present invention relates to an endless belt rotating apparatus for conveying an object in the form of a sheet. More specifically, it relates to an endless belt rotating apparatus which is made up of a pair of endless belts and is structured so that the pair of endless belts rotates while remaining pressed upon each other. As one of the examples of an endless belt rotating apparatus, there is an image forming apparatus of a belt nip type, which is mounted in an image forming apparatus.

There are various image heating apparatuses, for example, a fixing apparatus for heating an unfixed image on recording medium to fix the unfixed image to the surface of recording medium, a glossiness increasing apparatus for heating a fixed image on recording medium in order to increase the image in glossiness, and the like.

There have been proposed various fixing apparatuses, which are to be mounted in an electrophotographic image forming apparatus. One of such fixing apparatuses is made up of an endless fixation belt and an endless pressure belt, which rotate while remaining pressed upon each other. This apparatus fixes an unfixed image on a sheet of recording medium while the recording medium is conveyed between the two belts while remaining sandwiched by the belts (Japanese Laid-open Patent Application 2004-341346). A fixing apparatus of this type (which employs a fixation belt and a pressure belt) is substantially wider (in terms of the recording medium conveyance direction) in the fixation nip than a fixing apparatus which employs a pair of rollers).

A fixing apparatus of the belt nip type, that is, a fixing apparatus which employs a fixation belt or a pressure belt, sometimes suffers from the problem that while the belt is rotationally driven, it deviates in its widthwise direction, that is, the direction perpendicular to the direction in which recording medium is conveyed by the belt. As this phenomenon (belt deviation) occurs, it is possible that the belt will slip off from the rollers which support the belt, or the belt will be damaged across its edge portions.

Thus, various methods are used to compensate for the above-described belt deviation. According to one of these methods, one of the multiple rollers which support the belt is used as a steering roller, and compensation is made for the belt deviation by tilting the rotational axis of the steering roller (Japanese Laid-open Patent Application H05-27622).

The method for compensating for the belt deviation, which is proposed in Patent Document 2, is such a method that if it is detected that the amount by which the belt has deviated from its preset position has exceeded a preset amount, the steering roller is tilted in the direction to shift the belt in the opposite direction in which the belt has deviated (this control method hereafter will be referred to as "belt deviation control of swing type"). With the employment of this belt deviation control, the belt is periodically moved from one side of the belt supporting rollers to the other; the belt deviation can be reliably controlled by this method.

According to another method for compensating for the belt deviation, the belt position is detected, and then, the steering roller is adjusted in angle, according to the detected belt position (this control method hereafter will be referred to as "belt deviation control of equilibrium type"). This control method, or the equilibrium type belt deviation control method, can reliably keep the belt centered, that is, positioned so that its center in terms of its width continues to coincide with the center of the steering roller.

However, the belt deviation controlling method disclosed in Japanese Laid-open Patent Application H05-27622 suffers from the following problem. That is, as the belt is used (rotated), it is gradually worn across its internal surface, and the wear increases the friction caused by the internal surface of the belt. Thus, as the cumulative usage of the belt increases, the friction between the belt and belt supporting rollers becomes substantial, making it impossible for the abovementioned tilting of the steering roller to generate a sufficient amount of force to shift the belt in the direction opposite to the direction of the belt deviation. Consequently, the belt on the steering roller is also made to deviate by the other belt beyond the point of no return.

In the case of the belt deviation control of the equilibrium type, the belt does not shift much, and therefore, the internal surface of the belt does not wear much. Thus, the belt lasts longer than in the case of the belt deviation control of the swing type. In the case of the belt deviation control of the equilibrium type, however, the belt remains virtually centrally positioned. Therefore, the recording medium, which is a sheet of paper or the like, is repeatedly placed across the same portion of the belt in terms of the widthwise direction of the belt. Thus, if a large number of sheets of a thick recording medium, for example, pieces of cardboard or sheets of coated paper, are continuously conveyed through the fixing apparatus, the belt surface is microscopically damaged by the edges of the recording medium, thereby affecting the performance of the fixing apparatus. Therefore, in a case where a large number of sheets of thick or coated recording medium are continuously conveyed through a fixing apparatus, and then, a sheet of recording medium, which is greater in size (width) than the continuously conveyed large number of sheets of thick or coated recording medium, is conveyed through the fixing apparatus, the image on the larger recording medium becomes inferior in quality.

In addition, in recent years, a new type of paper, such as thick paper, which is glossier than conventional thick paper, or coated paper, which was given a special surface treatment, has come to be used as the recording medium (material). Further, not only cut paper of a standard size, but also, paper cut for a specific purpose (being therefore different in size from paper of the standard size), paper which is unusual in shape, various papers from various countries, etc., have come to be used for postal service. Further, it has become common practice to sell prints outputted by a private image forming apparatus. Thus, the level of quality which an image forming apparatus (fixing apparatus) is required to have has increased.

In fact, it is virtually impossible to develop a fixing apparatus (fixing device) which is not affected in image quality regardless of recording medium type. Further, even if it is possible to develop such a fixing apparatus, the amount of time, the money, and the resources that would be spent to develop such a fixing apparatus, will be vast.

SUMMARY OF THE INVENTION

Thus, the primary object of the present invention is to provide a fixing apparatus, the fixation belt or pressure belt of which has a significantly longer service life than those of a conventional fixing apparatus, regardless of the type of the recording medium used for image formation.

According to an aspect of the present invention, there is provided an image heating apparatus heating an image on a recording material and the image heating apparatus comprising a rotatable belt member; a pressing member contacting to the belt member to nip and feed the recording material; a stretching member stretching the belt member; belt position detecting means detecting a position of the belt member with respect to a perpendicular to a rotational direction of the belt member; an executing portion capable of executing a first control mode for controlling a position of the belt member with respect to the direction by inclination of the stretching member on the basis of an output of the belt position detecting means, and a second control mode for controlling the position of the belt member with respect to the direction by inclination of the stretching member on the basis of the output of the belt position detecting means and for stabilizing the position of the belt member; an input portion inputting information relating to the recording material; and a selector for selecting the first control mode or the second control mode in accordance with the information inputted to the input portion.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Embodiment 1

Figure 2:
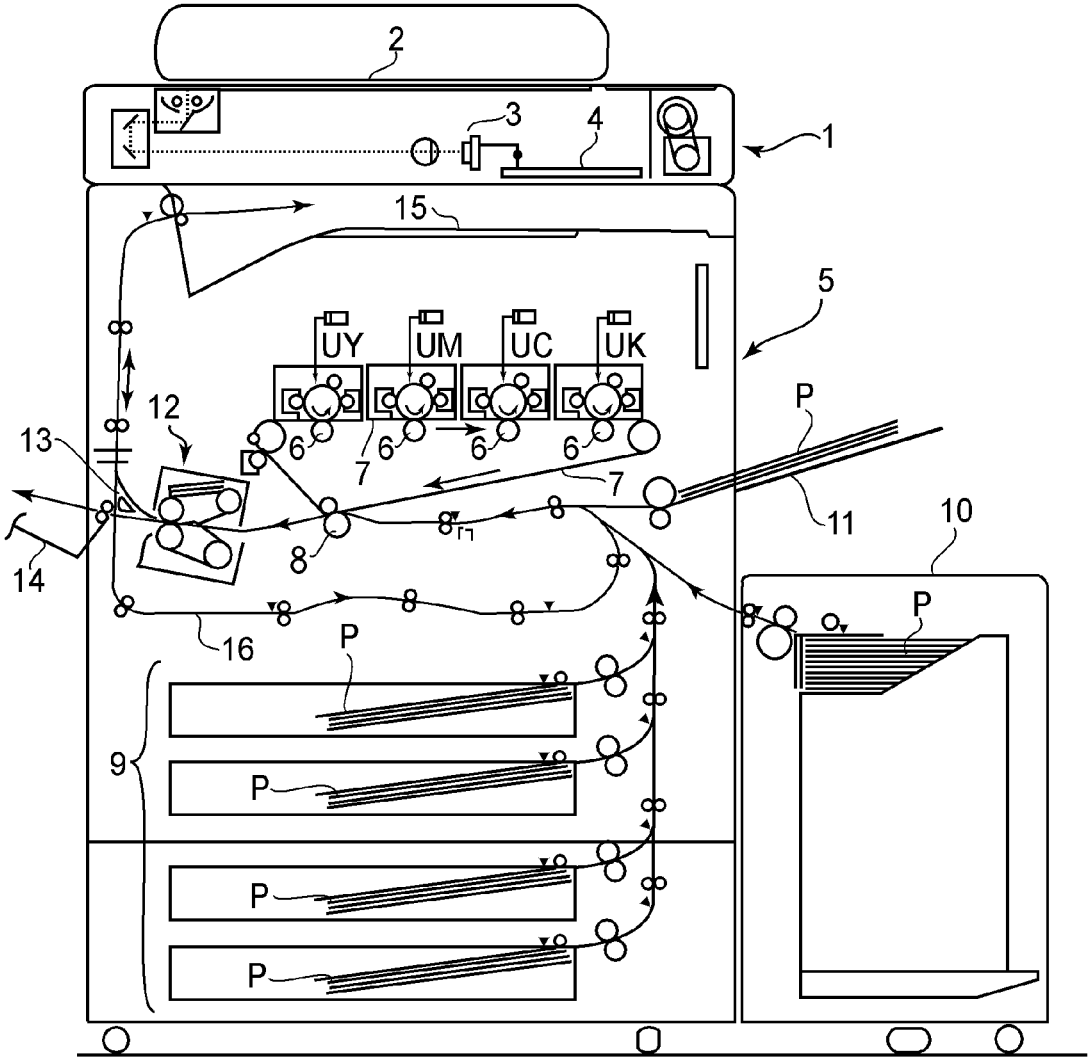
FIG. 2 is a vertical sectional view of the image forming apparatus, more specifically, an electrophotographic full-color copying machine, in the first embodiment, and shows the general structure of the apparatus.

(1) Description of Overall Structure of Electrophotographic Full-Color Copying Machine FIG. 2 is a vertical sectional view of an image forming apparatus, more specifically, an electrophotographic full-color copying machine, whose fixing apparatus in accordance with the present invention, is in the form of an endless belt rotating apparatus. It shows the general structure of the apparatus.

Designated by a reference numeral 1 is a digital color image reading portion, which photoelectrically reads a full-color original placed on an original placement platen 2. The digital color image reading portion 1 separates the image of the original into monochromatic color images, and outputs electric signals which correspond to numerous points of each of the monochromatic color images, with use of its full-color sensor 3 (CCD). The electric signals are processed by an image signal processing portion 4, and then, are sent to a digital color image printer portion 5.

The printing portion 5 has four image forming portions, that is, first to fourth image forming portions UY, UM, UC, and UK, which are arranged in tandem. Each image forming portion is an electrophotographic image processing portion. It uses an exposing method which uses a laser. The first image forming portion UY forms a yellow toner image on the peripheral surface of its photosensitive drum in response to the abovementioned electric signals, which are obtained by separating the image of the original, and sent to the printing portion 5 from the original reading portion 1. The second image forming portion UM forms a magenta toner image on the peripheral surface of its photosensitive drum with preset control timing. Further, the third and fourth image forming portions UC and UK form cyan and black toner images on their peripheral surfaces, with preset control timings, respectively.

The abovementioned toner images formed on the peripheral surfaces of the photosensitive drums in the image forming portions, one for one, are sequentially transferred in layers onto an intermediary transfer belt 7 in the primary transfer portion 6. As a result, an unfixed full-color toner image is synthetically formed on the surface of the intermediary transfer belt 7. The unfixed full-color image on the intermediary transfer belt 7, that is, the combination of the four monochromatic toner image placed in layers on the intermediary transfer belt 7, is transferred (secondary transfer), in a manner of being peeled away from the intermediary transfer belt 7, onto one of the sheets P of a recording medium, conveyed to a secondary transfer portion 8 from one of the cassettes in a recording medium feeding portion 9, a recording medium feeding deck 10, or a manual recording medium feeding portion 11.

After the transfer of the unfixed full-color toner image onto the sheet P of recording medium on the intermediary transfer belt 7, the sheet P is separated from the intermediary transfer belt 7, and is introduced into a fixing apparatus 12 (fixation unit) of the belt type, and is conveyed through the fixation nip of the fixing apparatus 12 while remaining pinched by the fixation nip. While the sheet P is conveyed through the fixation nip, the unfixed monochromatic toner images making up an unfixed full-color toner image, are melted and mixed. As a result, the four unfixed monochromatic images become fixed to the sheet P, yielding thereby a fixed full-color toner image on the sheet P. After coming out of the fixing apparatus 12, the sheet P is discharged into a delivery tray 14, with the image bearing surface facing upward, or is discharged into a delivery tray 15, with the image bearing surface facing downward, by being switched in its advancement path.

When the image forming apparatus is in the two-sided printing mode, the recording sheet P having come out of the fixing apparatus 12 after an image was fixed on its first surface is temporarily sent into the sheet path, which leads to the face-down delivery tray 15. Then, it is switched in conveyance direction, and introduced into a reconveyance path 16 so that it is reintroduced into the second transfer portion 8. Then, a toner image (toner images) is transferred onto the second surface of the recording medium P. Thereafter, the recording medium P is introduced into the fixing apparatus 12 of the belt type as it was after an unfixed toner image was formed on its first surface. Then, the recording medium P having two fixed toner images on the first and second surfaces, one for one, is discharged into the face-up delivery tray 14 or face-down delivery tray 15.

(2) Description of General Structure of Fixing Apparatus 12 of Belt Type

Figure 1:
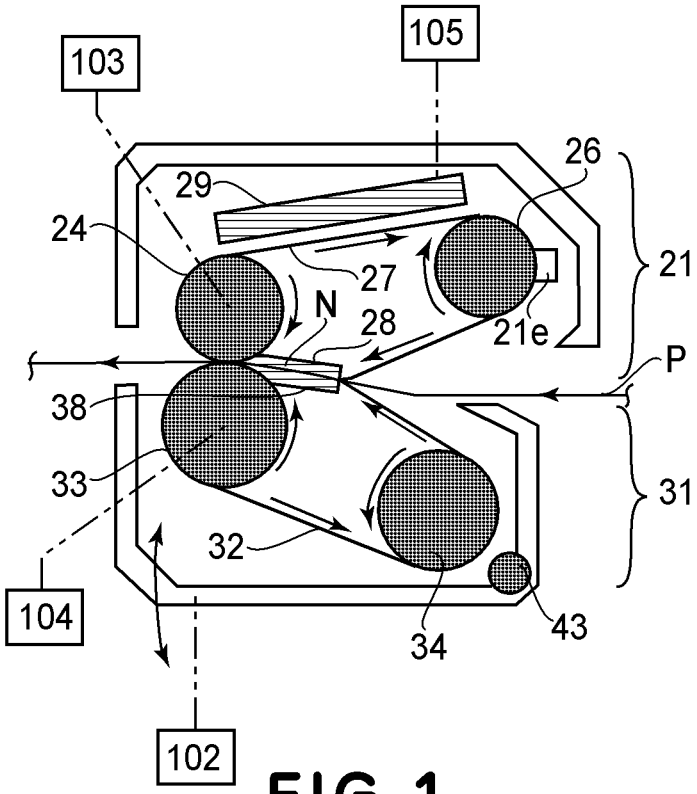
FIG. 1 is a vertical sectional view of the fixing apparatus of the belt type (endless belt rotating apparatus) in the first preferred embodiment of the present invention, and shows the general structure of the apparatus.

FIG. 1 is a sectional view of the image heating apparatus in this embodiment, more specifically, the fixing apparatus 12 of the belt type. It depicts the general structure of the apparatus. This fixing apparatus 12 of the belt type is in the form of a belt rotating apparatus. It has two belts, that is, the first and second belts, which rotate while being kept pressed against each other.

Regarding the naming of the various portions of the fixing apparatus 12, the front side of the apparatus means the side having the recording medium entrance. The left (rear) and right (front) sides are the left (rear) and right (front) sides, respectively, as seen from the front side of the fixing apparatus 12. The upstream and downstream sides of the fixing apparatus 12 refer to the upstream and downstream sides, respectively, in terms of the recording medium conveyance direction. The widthwise direction of the fixing apparatus 12 refers to the direction which coincides with the recording medium conveyance plane, and is perpendicular to the recording medium conveyance direction. The width of the fixing apparatus 12 is the dimension of the fixing apparatus in terms of the direction perpendicular to the recording medium conveyance direction.

Designated by a reference numeral 21 is a fixation belt unit, which is the upper unit of the fixing apparatus 12 of the belt type. The fixing belt unit 21 has an endless fixation belt 27 (first belt), a belt driving roller 24 and a belt steering roller 26. The belt driving roller 24 and belt steering roller 26 (which hereafter will be referred to simply as driving roller 24 and steering roller 26, respectively) are located on the inward side of the loop which the fixation belt 27 forms, and play the role of keeping fixation belt 27 stretched and supporting the fixation belt 27. The fixation belt unit 21 has also a pressure pad 28, which is located on the inward side of the fixation belt loop. It is a pressure applying means for keeping the fixation belt 27 pressed against an endless pressure belt 32, which will be described later. The fixation belt 27 is heated by an induction heating coil 29, which is a heat source located in the top portion of the fixation belt unit 21. More specifically, heat is inductively generated in the fixation belt 27 by the induction heating coil 29. The fixation belt 27 is 75 μm in thickness, 380 mm in width, and 200 mm in circumference. It is made up of a magnetic metallic layer (for example, nickel layer or stainless steel layer), and a 300 μm thick silicon rubber layer coated on the magnetic metallic layer.

Designated by a reference numeral 31 is a pressure belt unit, which is the bottom unit of the fixing apparatus 12 of the belt type. The pressure belt unit has an endless pressure belt 32 (second belt), a pressure belt driving roller 33 and a pressure belt steering roller 34. The pressure belt driving roller 33 and pressure belt steering roller 34 (which hereafter will be referred to simply as driving roller 33 and steering roller 34, respectively) are located on the inward side of the loop which the pressure belt 32 forms, and play the role of keeping the belt 32 stretched and supporting the pressure belt 32. The pressure belt unit 31 has also a pressure pad 38, which is located on the inward side of the pressure belt loop. It is a pressure applying means for keeping the fixation belt 32 pressed against the endless fixation belt 27.

The pressure belt unit 31 is rotationally movable about a shaft 43 so that the pressure belt 32 is virtually vertically movable. More specifically, the pressure belt 32 is vertically movable by a mechanism 102 for placing the pressure belt 31 in contact with the fixation belt 27, or separating the pressure belt 32 from the fixation belt 27. The mechanism 102 is made up of a solenoid plunger mechanism, a cam mechanism, a lever mechanism, etc. The pressure belt unit 31 is placed in the first state, in which it remains in contact with the fixation belt unit 21, by being rotationally moved upward. It is also placed in the second state, in which it is kept separated from the fixation belt unit 21, by being rotationally moved downward.

FIG. 1 depicts the fixing apparatus 12 of the belt type when the apparatus is in the first state, in which the fixation belt 27 and pressure belt 32 are kept in contact with each other by their portions which correspond in position to the belt driving roller 24 and pressure pad 28 of the fixation belt unit 21, and the belt driving roller 33 and pressure pad 38 of the pressure belt unit 32, respectively, forming thereby a fixation nip N, which is substantially wider in terms of the recording medium conveyance direction than the fixation nip of a conventional fixing apparatus.

Figure 3:
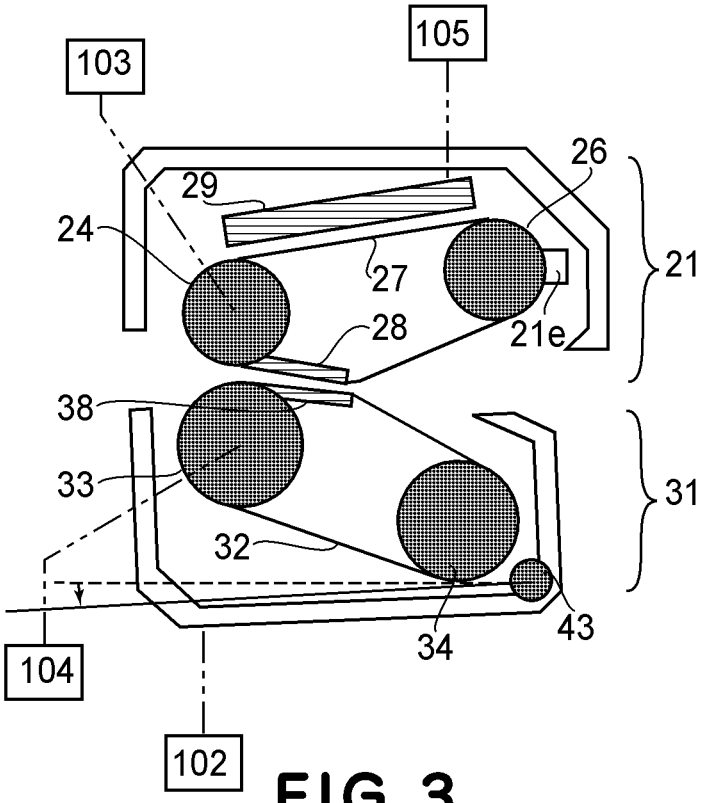
FIG. 3 is a vertical sectional view of the fixing apparatus of the belt type when the two belts are not in contact with each other.

FIG. 3 depicts the fixing apparatus 12 in the second state. When the fixing apparatus 12 is in this state, the pressure having been applied to the fixation belt unit 21 by the pressure belt unit 31 has been removed, and therefore, the pressure belt 32 is not in contact with the fixation belt 27.

The fixing apparatus 12 is structured so that it is switched in state from the second state to the first state just before it begins a fixing operation, that is, just before the recording medium P begins to be conveyed through the fixation nip N while remaining pinched by the two belts. Then, as soon as the fixing operation ends, the state of the fixing apparatus 12 is switched from the first state to the second state, preventing thereby an unnecessary amount of pressure from remaining between the fixation belt unit 21 and pressure belt unit 31, to prevent the components of the fixing apparatus 12 from being unnecessarily worn and/or damaged.

When the fixing apparatus 12 is in the state depicted in FIG. 1, that is, when it is in a fixing operation, the fixation belt driving roller 24 is rotationally driven by a fixation belt driving roller driving mechanism 103, whereby the fixation belt 27 is circularly driven in the clockwise direction, indicated by an arrow mark, by the driving roller 24. As for the fixation belt steering roller 26, it is rotated by the circular movement of the fixation belt 27. Further, the pressure belt driving roller 33 is rotationally driven by a pressure belt driving roller driving mechanism 104, whereby the pressure belt 32 is circularly driven in the counterclockwise direction, indicated by an arrow mark, by the driving roller 33. As for the pressure belt steering roller 34, it is rotated by the circular movement of the pressure belt 32. Further, high frequency electrical current is applied to the inductive heating coil 29 (heat source) from a heating power supplying circuit 105 (exciting circuit) to inductively heat the fixation belt 27. The surface temperature of the fixation belt 27 is detected by a temperature detecting means 21*e*, such as a thermistor. The electrical information regarding the temperature of the fixation belt 27 is inputted into a CPU 100 (FIG. 4), which is a control circuit (controller). The CPU 100 keeps the temperature of the fixation belt 27 at a preset fixation level, by turning on or off the electricity, which is supplied from the heating power supply circuit 105 to the inductive heating coil 29, in response to the information regarding the temperature of the fixation belt 27, which is inputted from the temperature detecting means 21*e*.

While the temperature of the fixation belt 27 is kept at the fixation level after being raised thereto, the recording medium P, bearing an unfixed toner image (toner images), is introduced into the fixing apparatus 12 from the front side, and is positioned so that the surface of the recording medium P, which is bearing the unfixed toner image (images), faces the fixation belt 27. Then, while the recording medium P is conveyed through the fixation nip N while remaining pinched between the fixation belt 27 and pressure belt 32, the unfixed toner image (images) is fixed to the surface of the recording medium P by the heat and pressure in the fixation nip N.

Figure 4:
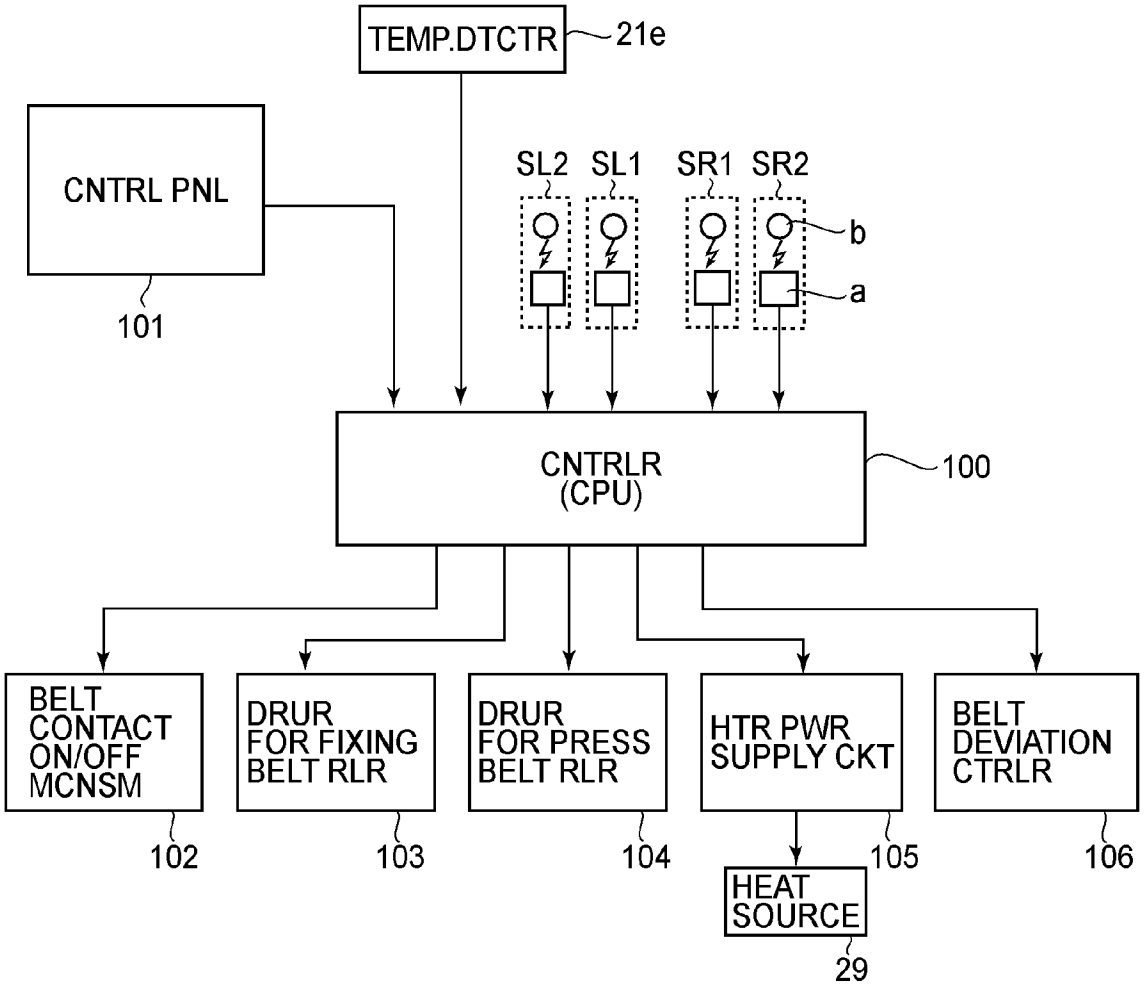
FIG. 4 is a block diagram of the control system of the fixing apparatus.

FIG. 4 is a block diagram of the control system of the image forming apparatus (inclusive of fixing apparatus 12 of belt type) in this embodiment. The overall operation of the image forming apparatus is controlled by the CPU 100, which is in the form of the control circuit (controller). To the CPU 100, a control portion 101 made up of a liquid crystal touch panel, buttons, etc., is connected. The image forming apparatus begins its image forming operation after various conditions (operational settings) are inputted by a user through the control portion 101.

The CPU 100 controls: the mechanism 102 for placing the pressure belt 32 in contact with the fixation belt 27, or separating the pressure belt 32 from the fixation belt 27, a fixation roller driving roller driving mechanism 103; a pressure belt driving roller driving mechanism 104; a heating power supply circuit 105, which was mentioned above; and a belt deviation controlling mechanism 106 (steering roller angle controlling mechanism), which will be described in Section (3), which is the next section. To the CPU 100, belt deviation amount detection sensors SL1, SL2, SR1, SR2, etc., (belt position detecting means) are connected, which also are controlled by the CPU 100.

The belt deviation controlling mechanism 106 is a belt steering means for controlling the amount by which a belt is moved in the direction parallel to the rotational axes of the belt suspending means. It controls the amount of belt movement by changing the alignment of at least one of the multiple belt suspending means. The belt deviation controlling mechanism 106 in this embodiment carries out an operation for compensating for the positional deviation of the fixation belt 27 and the pressure belt 32 by driving the steering control stepping motor 60 of the belt deviation controlling mechanism 106, shown in FIG. 5, in response to the signals from the CPU 100. The belt deviation detection sensors SL1, SL2, SR1, and SR2 are the sensors for detecting the amount of deviation of the fixation belt 27, and the amount of deviation of the pressure belt 32.

(3) Description of Belt Deviation Controlling Mechanism

Figure 5:
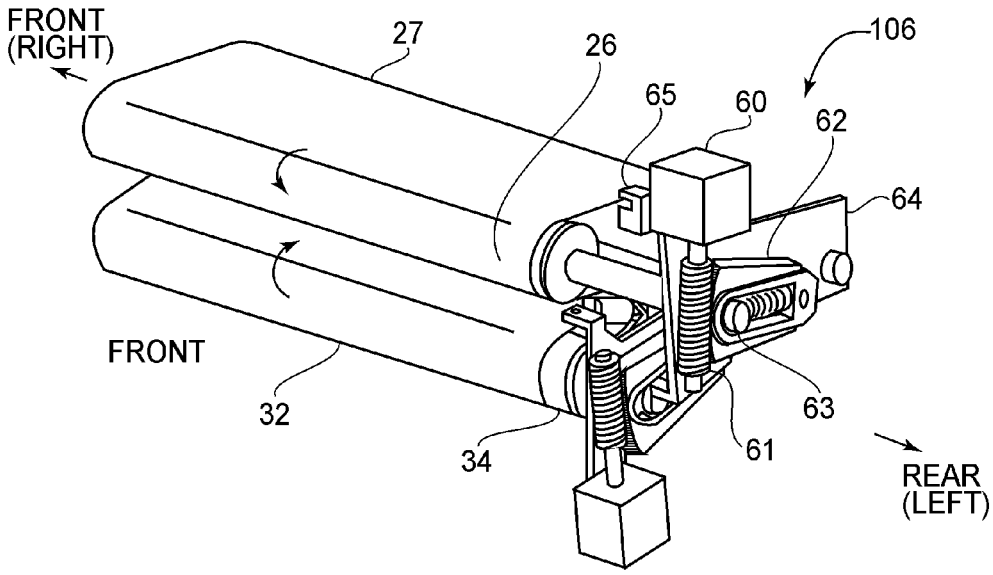
FIG. 5 is a perspective view of the belt deviation control mechanism.

Next, referring to FIG. 5, the belt deviation control mechanism 106 of the fixing apparatus 12 of the belt type in this embodiment will be described. The belt deviation control mechanism 106 of the fixation belt unit 21, and the belt deviation control mechanism of the pressure belt unit 31, are roughly the same. Thus, only the belt deviation control mechanism 106 of the fixation belt unit 21 will be described as the belt deviation control mechanism which represents both belt deviation control mechanisms.

The belt deviation control mechanism 106 is made up of a steering control stepping motor 60, a worm gear 61, a fan-shaped gear 62, a steering roller bearing 63, and a lateral plate 64 which supports the preceding components. The steering roller bearing 63 supports the axle of the fixation belt steering roller 26. Designated by a reference numeral 65 is a left belt deviation sensor unit, which has two photosensors SL1 and SL2 for detecting the belt deviation in two stages. The left belt deviation sensor unit 65 will be described later in detail. There is also a right belt deviation sensor unit on the right side of the belt 27. It is similar to the left belt deviation sensor unit. However, it is not shown in FIG. 5.

As the stepping motor 60 is driven in a direction CW (clockwise direction), the worm gear 61 rotates, causing the fan-shaped gear 62 to rotationally move downward about its axis. As a result, the steering roller bearing 63 is moved downward, causing the fixation belt steering roller 26 to slightly tilt rearward (leftward with reference to belt rotation direction, as seen from directly above). Thus, the entirety of the fixation belt unit 21 tilts so that its rear end is positioned lower than its front end. Therefore, the following rotation of the fixation belt 27 causes the fixation belt 27 to gradually move frontward (rightward).

On the other hand, as the stepping motor 60 is driven in a direction CCW (counterclockwise), the worm gear 61 rotates, causing the fan-shaped gear 62 to rotationally move upward about its axis. As a result, the steering roller bearing 63 is moved upward, causing thereby the fixation belt steering roller 26 to tilt so that its front end (right with reference to belt rotation direction, as seen from above) is positioned slightly lower than its rear end. Thus, the entirety of the heating belt unit tilts so that its rear end is positioned higher than its front end. Therefore, the following rotation of the fixation belt 27 causes the fixation belt 27 to gradually move rearward (leftward).

Figure 6:
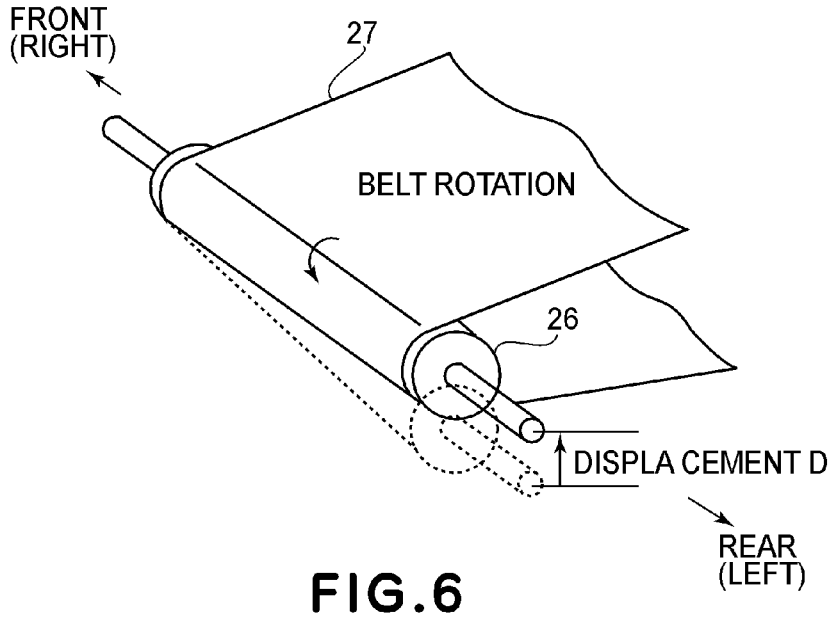
FIG. 6 is a schematic drawing for describing the method for compensating for the snaking of the belt.

FIG. 6 is a drawing of the steering roller 26 tilted to cause the fixation belt 27 of the fixation belt unit 21 to move rightward (as seen from above) with reference to the belt rotation direction. The mechanism for tilting the steering roller 26 is at the rear end of the fixing apparatus 12 as described above. Thus, in order to cause the fixation belt 27 to move rightward, the steering roller 26 is tilted so that its rear end is positioned higher than its front end. Hereafter, the amount of this displacement of the rear end of the steering roller 26 will be referred to as the rear end displacement amount D. The upward displacement of the rear end of the steering roller 26 will be referred to as the positive (+) displacement, which causes the fixation belt 27 to move rightward with reference to the belt rotation direction, whereas the downward displacement of the rear end of the steering roller 26 will be referred to as the negative (−) displacement, which causes the fixation belt 27 to move leftward relative to the belt rotation direction.

The change in the rear end displacement amount D is likely to cause the belt 27 to move in its widthwise direction. Thus, as the angle of the steering roller 26 is set so that the amount of the displacement D becomes ±0, the belt is not displaced leftward nor rightward from the position corresponding to this steering roller angle. In reality, however, the belt is made to deviate in position by various causes; the belt is made to move leftward or rightward relative to the rollers which are suspending and stretching the belt.

Described above referring to FIGS. 5 and 6 is the fixation belt unit 21. As for the pressure belt unit 31, its basic structure is the same as that of the fixation belt unit 21.

(4) Belt Deviation Detection, and Description of Control for Compensating for Belt Deviation Next, referring to FIG. 7, the belt deviation detecting means will be described in detail. The method for detecting the positional deviation of the fixation belt 27 and the method for detecting the positional deviation of the pressure belt 32 are basically the same. Thus, the method for detecting the positional deviation of the fixation belt 27 will be described as the method which represents both methods.

Figure 7:
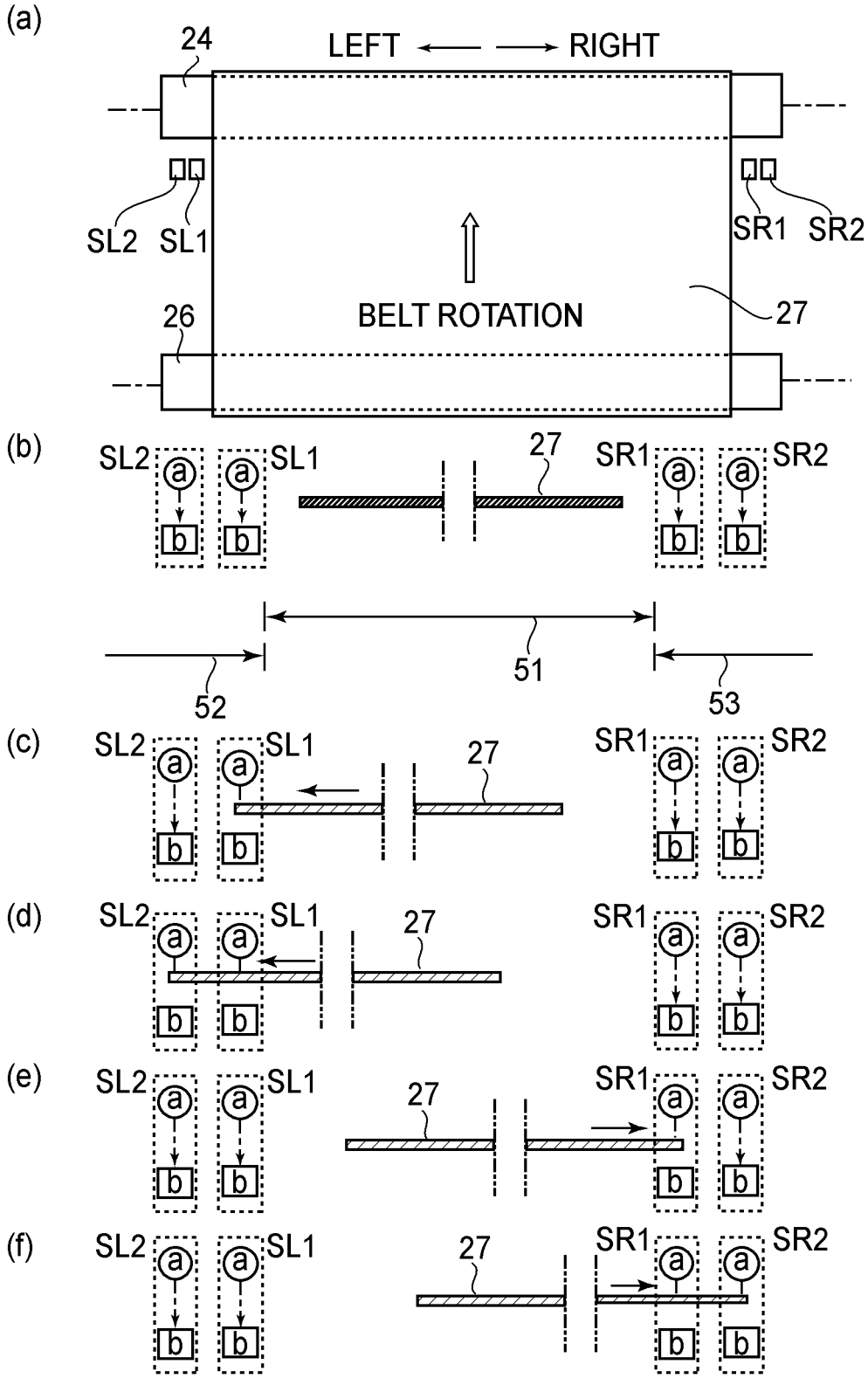
FIGS. 7(*a*)-7(*f*) are schematic drawings for describing a point to which the belt has snaked, and the sensor for detecting the point to which the belt has deviated.

FIG. 7(*a*) is a schematic top plan view of the combination of the belt driving roller 24, steering roller 26, and fixation belt 27. Designated by the reference characters SL1 and SL2 are the first and second belt deviation detecting means, which are on the left side of the fixation belt 27. Designated by the reference characters SR1 and SR2 are the first and second belt deviation detecting means, which are on the right side of the fixation belt 27. In terms of the widthwise direction of the fixation belt 27, the first belt deviation detecting means SL1 and SR1 are positioned the same distance (preset distance) away from the fixation belt 27, and the second belt deviation detecting means SL2 and SR2 are positioned the same distance (preset distance) away from the fixation belt 27. However, the second belt deviation detecting means SL2 and SR2 are positioned farther away from the fixation belt 27 than the first belt deviation detecting means SL1 and SR1. Referring to FIG. 7(*b*), each of the belt deviation detecting means SL1, SR1, SL2, and SR2 is an optical sensor (photosensor) made up of a combination of a light sending element a and a light receiving element b. They are is positioned so that as the fixation belt 27 moves leftward or rightward more than a preset distance in terms of the widthwise direction of the fixation belt 27 while it is circularly driven, one of the edge portions of the fixation belt 27 blocks the light passage between the light sending element a and light receiving element b, by entering the gap between the two elements a and b. Each of the sensors SL1, SL2, SR1, and SR2 is in the state of ON when the light passage is open, and in the state of OFF when the light passage is blocked.

FIGS. 7(*a*) and 7(*b*) depict the state of the fixation belt 27, in which the fixation belt 27 remains within the tolerable range of deviation, that is, the range between the first left sensor SL1 and the first right sensor SR1, and therefore, both sensors SL1 and SR1 are in the state of ON. Since both sensors SL1 and SR1 are on, the CPU determines that the fixation belt 27 is being circularly driven while remaining within the tolerable range of deviation. Hereafter, this tolerable range of deviation for the fixation belt 27 will be referred to as the normal range 51 of deviation.

As the fixation belt 27 continuously moves leftward, the first left sensor SL1 is turned off by the left edge portion of the fixation belt 27 as shown in FIG. 7(*c*). Thus, the CPU determines that the fixation belt has moved leftward too far. Then, the CPU tilts the steering roller 26 in the direction to move the fixation belt 27 in the opposite direction, that is, rightward, by activating the belt deviation control mechanism 106; it tilts the steering roller 26 so that the left end of the steering roller 26 is positioned higher than the right end. If the fixation belt 27 continues to move leftward, in spite of this tilting of the steering roller 26, until the second left sensor SL2 is turned off as shown in FIG. 7(*d*), the CPU increases the angle of the steering roller 26. Then, if the second left sensor SL2 remains turned off 10 seconds after the increase in the angle of the steering roller 26, the CPU determines that the fixation belt 27 has moved leftward too far to be moved back rightward. Then, the CPU stops the fixation roller 24 (which drives the fixation belt 27) in order to prevent damage to the fixation belt 27. Further, it stops the entirety of the image forming apparatus (ongoing image forming operation), and displays an error message on the monitor portion of the control portion 101 to prompt a user to contact a service person. Hereafter, this range of leftward deviation of the fixation belt 27 will be referred to as the left abnormal range 52.

On the other hand, as the fixation belt 27 continuously moves rightward, the first right sensor SR1 is turned off by the right edge portion of the fixation belt 27 as shown in FIG. 7(*e*). Thus, the CPU determines that the fixation belt 27 has moved rightward too far. Then, the CPU tilts the steering roller 26 in the direction to move the fixation belt 27 in the opposite direction, that is, leftward, by activating the belt deviation control mechanism 106; it tilts the steering roller 26 so that the right end of the steering roller 26 is positioned higher than the left end. If the fixation belt 27 continues to move rightward, in spite of this tilting of the steering roller 26, until the second right sensor SR2 is turned off as shown in FIG. 7(*f*), the CPU increases the angle of the steering roller 26. Then, if the second right sensor SR2 remains turned off 10 seconds after the increase in the angle of the steering roller 26, the CPU determines that the fixation belt 27 has moved rightward too far to be moved back leftward. Then, the CPU stops the entirety of the image forming apparatus (ongoing image forming operation), and displays the error message. Hereafter, this range of rightward deviation of the fixation belt 27 will be referred to as the right abnormal range 53.

(5) Description of Belt Deviation Control of Swing Type

The belt deviation control of the swing type, which is carried out in the first belt deviation control mode in this embodiment, is such a control that as the endless belt is controlled in its position in terms of the direction parallel to its rotational axis in response to the result of the detection of its position by the belt position detecting means, the belt is reciprocally moved in the direction parallel to its axial direction. In other words, it is such a belt deviation controlling method that repeats the steering operation for moving the fixation belt 27 in the opposite direction from the direction of the fixation belt deviation, in response to the state of each of the abovementioned sensors SL1, SL2, SR1, and SR2.

Figure 8:
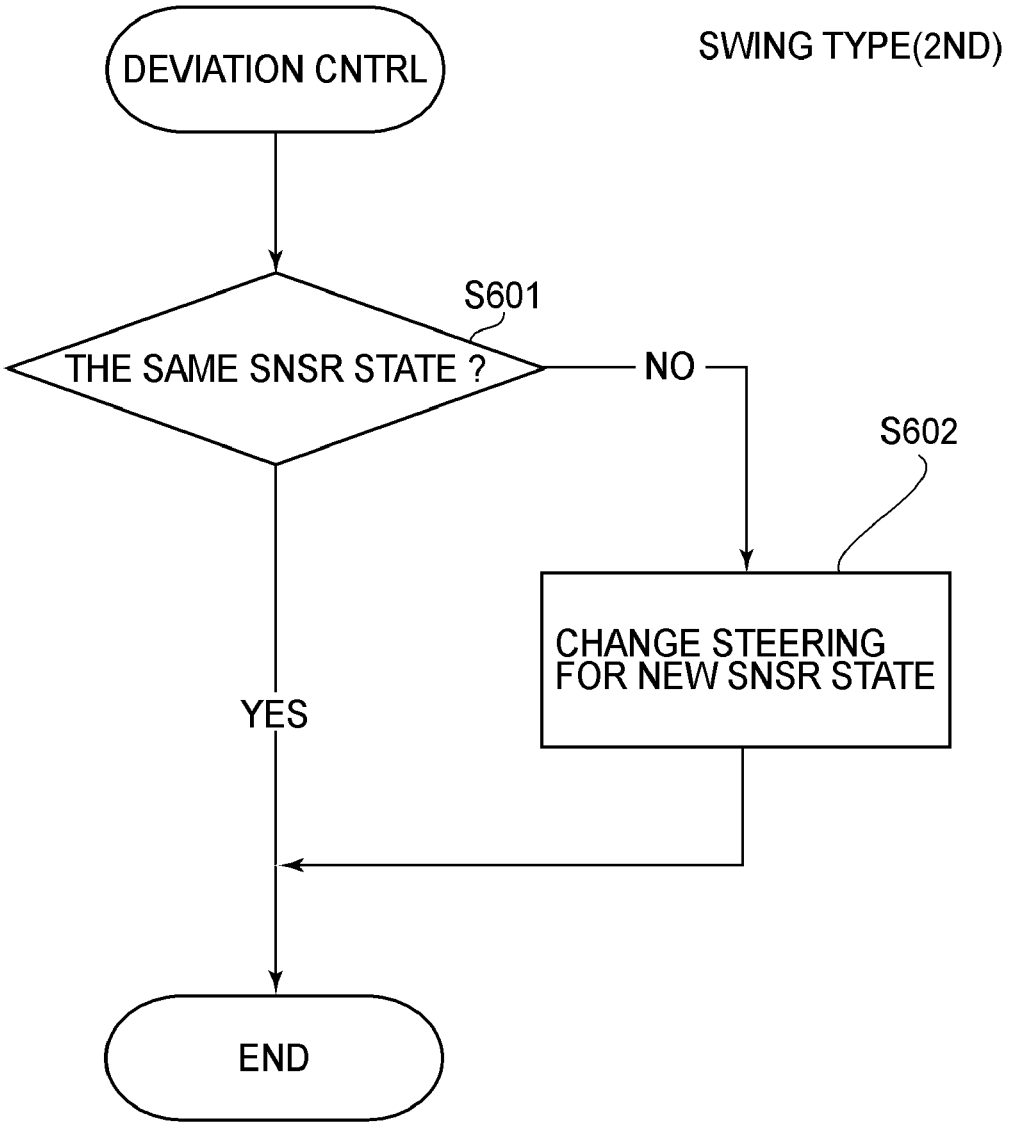
FIG. 8 is a flow chart of the belt deviation control (second control mode) of the swing type.

FIG. 8 is a flowchart which shows the procedural steps of the belt deviation control of the swing type. In a case where the belt deviation control of the swing type is carried out with preset intervals, first, the states of all of the sensors SL1, SL2, SR1, and SR2 are read in Step S601, and the results of the reading are compared to the results of the previous reading. If it is determined that the state of each sensor has not changed since the previous reading of the state of each sensor, the control is ended without carrying out any step. If it is determined that the state of any of the abovementioned sensors is different from the previous state of the same sensor, the amount by which the steering roller is steered (tilted) is changed in Step S602 according to the current state of the sensor. The amount by which the steering roller 26 is steered (tilted) is determined based on the table in FIG. 9.

In this embodiment, the two sensors SL1 and SL2 are positioned on the left side of the fixation belt 27, and the two sensors SR1 and SR2 are positioned on the right side of the fixation belt 27. However, the number of sensors does not need to be limited to the same number as that in this embodiment. Further, the detecting means does not need to be an optical sensor.

(6) Description of Belt Deviation Control of Equilibrium Type

The belt deviation control of the equilibrium type, which is carried out when the image forming apparatus is in the second belt deviation control mode, is such a control that keeps the endless belt in the state of positional equilibrium in terms of the direction parallel to its rotational axis, in response to the result of the detection of its position by the belt position detecting means.

Figures 9, 13:
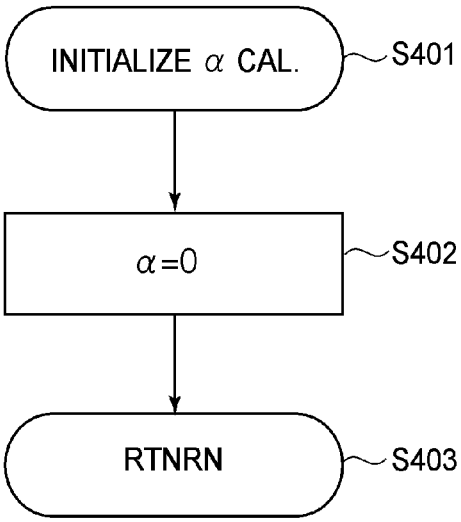
FIG. 9 is a table which shows the relationship between the state of the sensor for detecting the amount of belt snaking, and the amount by which the steering roller is to be moved to compensate for the snaking.
FIG. 13 is a flow chart of the algorithm for initializing the number (a) of the pulses, which is necessary to tilt the steering roller from the referential angle (attitude) to the equilibratory angle (attitude).

FIG. 9 is a table that shows the relationship between the number of steering roller driving pulses applied to compensate for the fixation belt deviation according to the states of the fixing belt deviation detection sensors SL2, SL1, SR1, and SR2, and the fixation belt position labels used for the belt deviation control.

The amount of steering, which is given in FIG. 9, corresponds to the number of the steps described next. That is, although not given in FIG. 9, the steering roller position, which can virtually prevent the fixation belt 27 from deviating leftward or rightward is set as the reference position (home position). The fixation belt unit 21 and pressure belt unit 31 are provided with a home position sensor, which remains turned on when the steering roller 26 is in its home position. The amount of steering is the number of pulses to be applied to drive the steering roller driving motor. A positive number of pulses means that the steering roller is to be tilted in the direction to move the belt rightward, whereas a negative number pulses means that the steering roller is to be tilted in the direction to move the belt leftward.

The columns 801 in FIG. 9 show the combination of the states (on or off) of the belt position sensors SL2, SL1, SR1, and SR2. When all the numbers in the columns 801 are 0, the belt is in the center zone. As soon as the belt moves to the center of the center zone, the steering roller is moved so that the belt moves to its equilibratory position. The number of times the steering roller driving motor is turned on to move the steering roller to its equilibratory position is a, which will be described later. The position label, which corresponds to this position is CT.

Similarly, when the belt is in the first state of its leftward deviation (SL1=1, and SL2=0), the amount of steering is 100 pulses, and the position label is L1. That is, 100 is the number of pulses for tilting the steering roller by the correct angle for moving the belt rightward to compensate for the belt deviation when the belt is in the first stage of its leftward snaking (deviation).

Similarly, when the belt is in the second stage of its leftward deviation (SL1=1, and SL2=1), the amount of steering is 200 pulses, and the position label is L2. That is, 200 is the number of pulses for tilting the steering roller by the correct angle for moving the belt rightward to compensate for the belt deviation when the belt is in the second stage of its leftward snaking (deviation).

Similarly, when the belt is in the first state of its rightward deviation (SR1=1, and SR2=0), the amount of steering is −100 pulses, and the position label is R1. That is, −100 is the number of pulses for tilting the steering roller by the correct angle for moving the belt leftward to compensate for the belt deviation when the belt is in the first stage of its rightward snaking (deviation).

Similarly, when the belt is in the second state of its rightward deviation (SR1=1, and SR2=1), the amount of steering is −200, and the position label is R2. That is, −200 is the number of pulses for tilting the steering roller by the correct angle for moving the belt leftward to compensate for the belt deviation when the belt is in the second stage of its rightward snaking (deviation).

Figure 10:
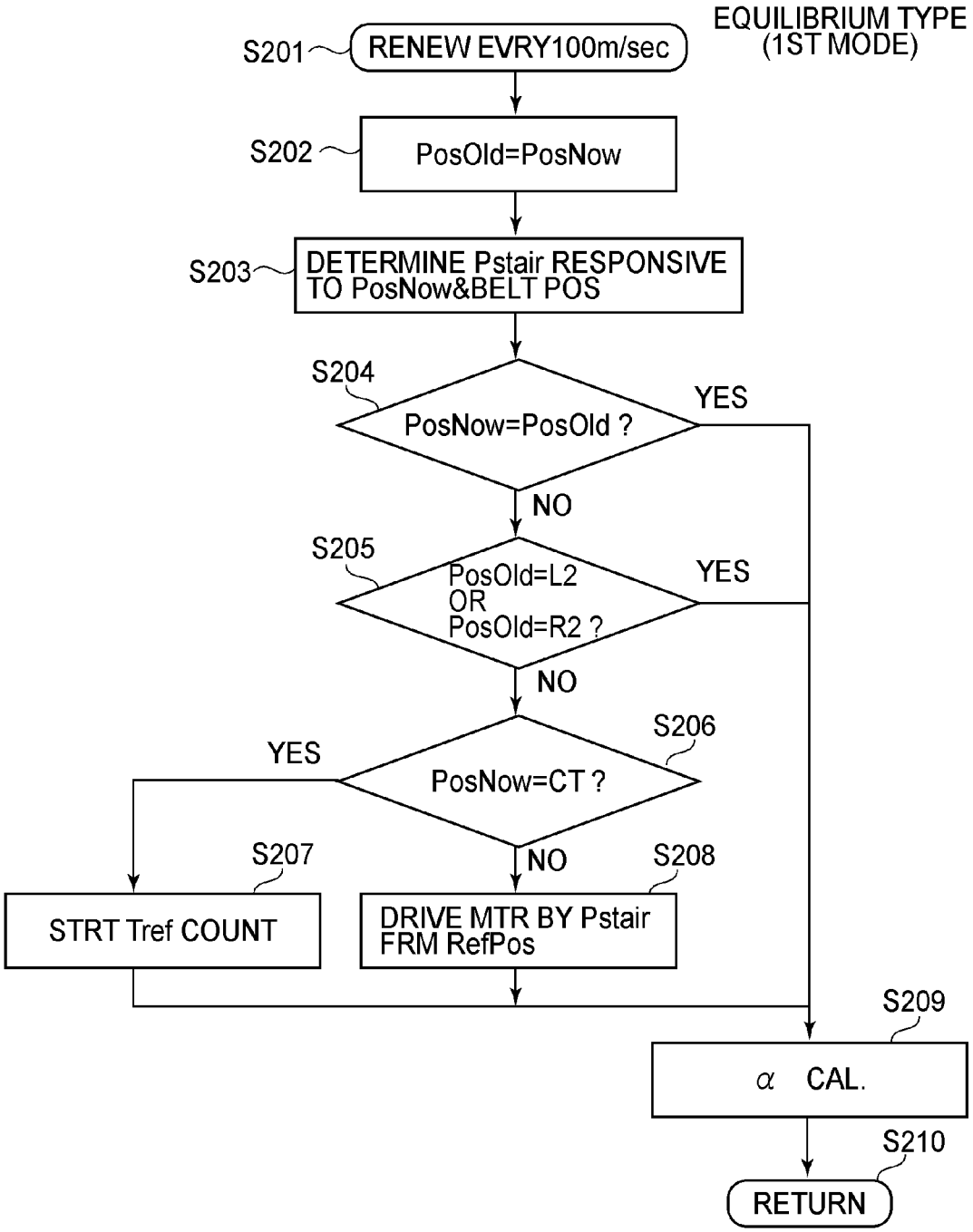
FIG. 10 is a flow chart of the belt deviation control (first control mode) of the equilibrium type.

Step S201 in FIG. 10 is the step which the CPU 100 carries out every 100 ms, which is clocked by an interval timer.

As soon as Step S201 is started, a belt position stored in PosNow, is retired into PosOld, in Step 202. Next, in Step S203, the state of each belt position sensor is detected, and the belt position label which corresponds to the combination of the detected belt states is found in the table in FIG. 9. Then, the position in PosNow is substituted with the found belt position label. At the same time, a steering pulse Psteer, which corresponds to the detected belt position, is determined. Next, in Step S204, the PosNow is compared with PosOld. If PostNow is the same as PosOld, it means that the belt has not changed in position, and therefore, it is unnecessary to steer the steering roller (jump to Step S209). If PosNow is different from PosOld, the method advances to Step S205, in which it is determined whether PosOld is L2 or R2. If the belt position is L2 or R2, it means that the belt has deviated beyond the L1 or R1; the belt has deviated beyond the range in which the belt deviation control, which is effective when the belt is in the first stage of deviation, is effective. Thus, the steering roller is kept in the position which corresponds to the belt position L2 or R2, until the belt moves to the center (PosNow=CT). Then, in Step S206, if the current belt position is at the center, the method advances to Step S207, in which a timer is started to measure the length of time it takes for the steering roller to return to the equilibratory position. Step S208 is performed when the belt position has changed from CT to L1 or R1, or when the belt position has changed from L1 to L2 or R2. That is, it is evident that Step S208 is to be performed when the belt has snaked outward from CT. Therefore, the belt has to be steered to be prevented from snaking Therefore, in Step S208, in order to stop the belt from snaking, the stepping motor is driven for a length of time (pulse count) which corresponds to the current belt position. In Step S209, $\alpha$, which is the number of pulses necessary to move the belt back to its equilibratory position is calculated. The algorithm for obtaining the value of $\alpha$ will be described later.

Figure 11:
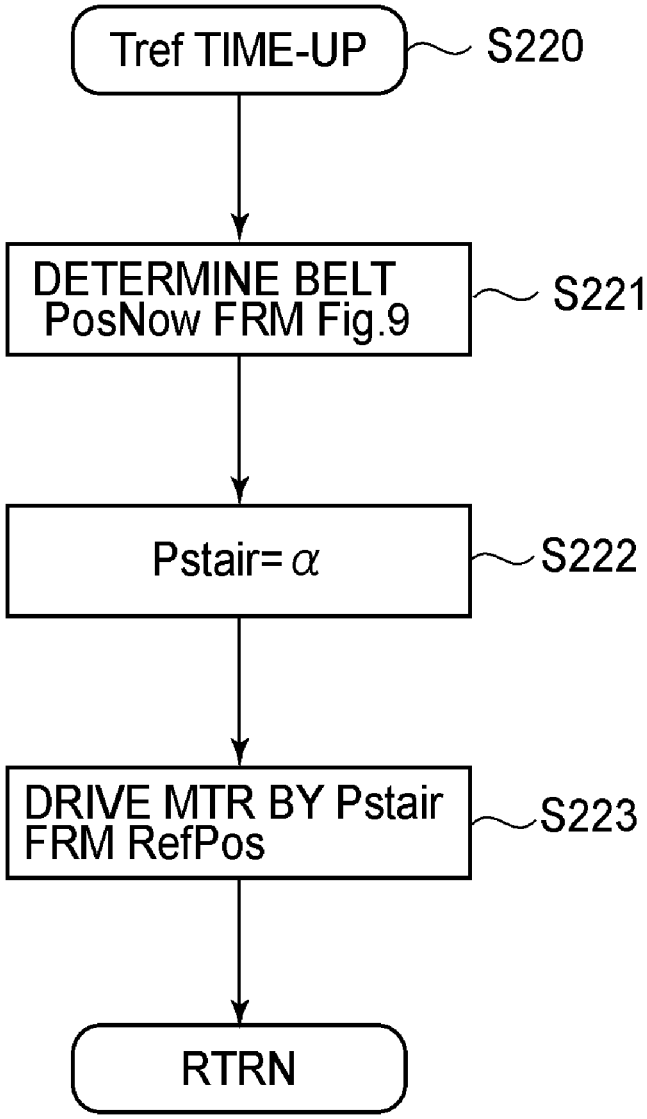
FIG. 11 is a flow chart of the control sequence for tilting the steering roller to its equilibratory position (attitude).

FIG. 11 is a flowchart of the control for tilting the steering roller to its equilibratory position as soon as the time Tret counts down to zero.

As the time set in the timer Tret runs out in Step S220, Step S221 is performed, in which the current belt position label is obtained from FIG. 9. If the belt position PosNow is CT in Step S221, it means that the belt is in the center zone, and therefore, Step S222 is performed, in which the steering amount $\alpha$ is set. Then, Step S223 is performed, in which the stepping motor is driven by the pulses, the number of which is equal to the value of $\alpha$, to tilt the steering roller relative to its referential angle (posture). If the belt position PosNow is not CT, it means that the belt has moved out of the center zone before the time set in the time Tret runs out. Therefore, the operation for returning the steering roller to the equilibratory position is not carried out, and the steering roller is tilted by a desired angle, following the flowchart in FIG. 10.

$\alpha$ is one of the essential parameters. It represents the number of pulses necessary to move the steering roller back into the equilibratory position. The steering roller can be always kept in its optimal position, that is, the equilibratory position, by finely adjusting $\alpha$. The two belts can be always kept at the optimal equilibrium position by finely adjusting the number ($\alpha$) of the pulses for driving the steering roller driving motor. The detail of this adjustment will be described later.

Figure 12:
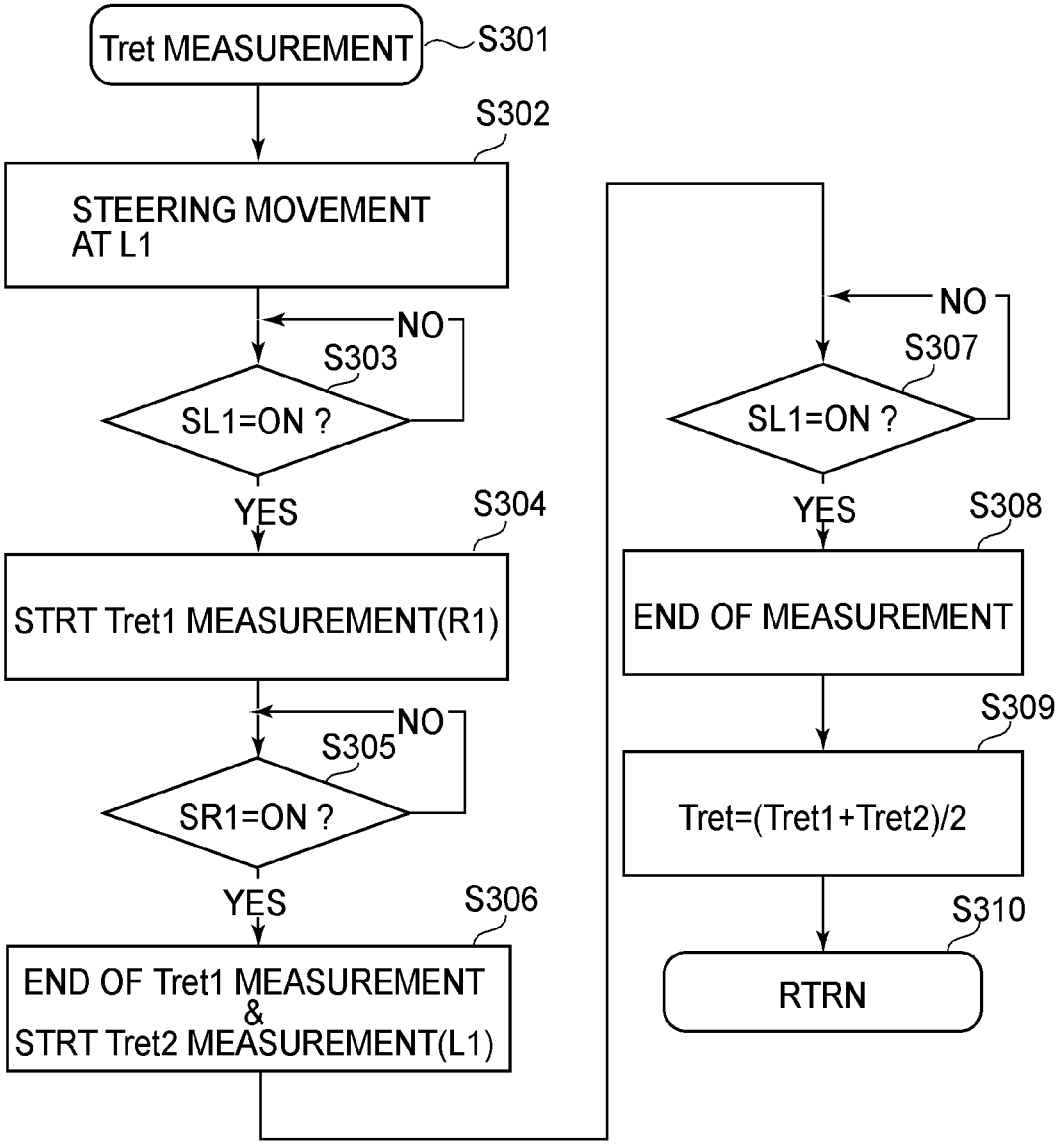
FIG. 12 is a flow chart of the sequence for calculating the value to be set in the timer Tret.

FIG. 12 is a flowchart of the sequence for calculating the value to be set in the timer Tret. This sequence calculates this value as soon as a fixing apparatus is mounted in the main assembly of an image forming apparatus.

First, in Step S302, the stepping motor is driven by pulses DL1 to tilt the steering roller, when the belt is in its center position and the steering roller is in its reference attitude. If the belt turns on the sensor SL1 in Step S303, the stepping motor is driven by pulses DL1 to reversely tilt the stepping motor relative to the reference attitudinal position in Step S304. At the same time, it is started to measure the length of time Tret1 it takes for the belt to move from the sensor SL1 to the sensor SR1. Next, if the sensor SR1 is turned on in Step S305, the measurement of the time Tret1 is stopped, and the stepping motor is driven by the pulses DL1 to tilt the steering roller relative to its referential attitudinal position. At the same time, it is started to measure the length of time Tret2 it takes for the belt to move from the sensor SR1 to the sensor SL1 (S306). Next, as soon as the sensor SL1 is turned on in Step S307, the measurement of the time Tret2 is ended in Step S308. Then, the average of the times Tret1 and Tret2 is calculated in Step 309, and the obtained average value is used as the time Tret in Step S310.

Although the following method is not used in this embodiment, the shorter of the time Tret1 and time Tret2, or either time Tret1 or time Tret 2, may be used as the value for the time Tret.

(7) Description of Fine Adjustment of α

It should be noted here that the abovementioned equilibratory angle (attitude) of the steering roller may continuously change, depending on: how parallel the rollers of the fixing apparatus are positioned when the fixing apparatus is assembled; the changes in the measurements of the apparatus attributable to thermal expansion; the wear of the components of the fixing apparatus attributable to usage; and the like factors. Further, it is rather difficult to find the true equilibratory angle (attitude), that is, such a steering roller angle (attitude) that will not allow the belt to deviate either leftward or rightward. In other words, the belt is likely to very gently snake leftward or rightward, because of the balance of the fixing apparatus. Thus, it may be thought that to find the equilibratory angle for the steering roller is to find the steering roller angle (attitude) which minimizes the snaking speed of the belt.

In this embodiment, therefore, the fixing apparatus is provided with a suspension controlling means for finely adjust the equilibratory angle, in order to always tilt the steering roller at the optimal angle under the above described circumstance. Next, referring to FIGS. 13 and 14, the algorithm for finely adjusting the angle of the steering roller so that the steering roller is optimally tilted to minimize the snaking of the belt will be described.

FIG. 13 is a flowchart of the algorithm for initializing the number (a) of the pulses, which is necessary to tilt the steering roller from the reference angle (attitude) to the equilibratory angle (attitude) in the flowchart in FIG. 10. The algorithm is carried out as soon as the image forming apparatus is turned on, or as soon as the fixing apparatus is remounted into the main assembly of the image forming apparatus after the fixing apparatus is removed from the main assembly for maintenance or the like. The reason for initializing a while the image forming apparatus is in use is that it is possible that the fixing apparatus will change in roller alignment with the elapse of time.

Figure 14:
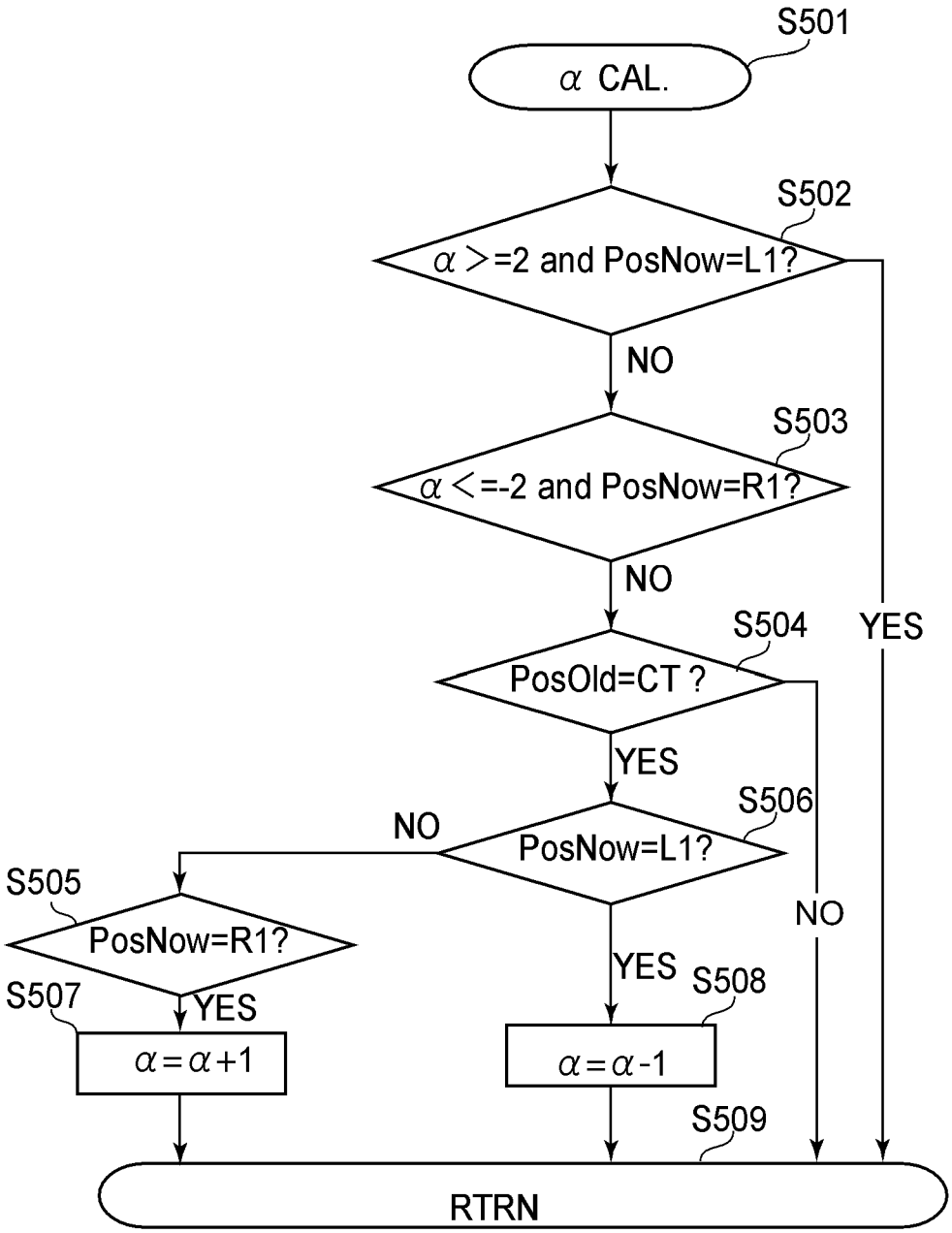
FIG. 14 is a flowchart related to the algorithm for compensating for the equilibratory angle.

FIG. 14 is the flowchart of the algorithm for adjusting the parameter α. In this flowchart, the frequency with which the belt snaked away from the center zone into the position L1 while the steering roller is in its equilibratory position (attitude), and the frequency with which the belt snaked away from the center zone into the position R1 while the steering roller is in its equilibratory position (attitude), are stored. Then, the parameter α is adjusted so that the belt shifts to the position associated with a lower frequency from which the belt snakes.

To begin with, in Step S502, if α is no less than 2, and the current position is L1, it means that although it was toward the position R1 that the belt tended to shift (deviate) when the steering roller was in the previous attitude, the belt has begun to shift (deviate) toward position L1. Therefore, it is assumed that the equilibrium has been achieved. Therefore, the fine adjustment of α is interrupted. Next, in Step S504, it is checked whether the belt has deviated from the belt position which corresponds to the equilibratory position of the steering roller, to the position L1 or R1 (whether it is the timing with which the value for α is recalculated, or not). If it is Yes, and the current position is L1 (S505), the value of α is reduced by one (to adjust a to cause the belt to tend to deviate rightward) (S507), whereas if the current position is R1, α is increased by one (to adjust α to cause the belt to tend to deviate leftward) (S508).

If the image forming apparatus (fixing apparatus) is in the first control mode, this belt suspension control is not carried out; it is carried out only in the second control mode. In the first control mode, the angle of the tension roller is 0. That is, the amount of the deviation of the belt in the direction parallel to the rotational axis of the tension roller in the first control mode when the belt is in its referential position, is greater than that in the second control mode.

(8) Description of Relationship Between Recording Medium Choice and Control

In the belt deviation control of the equilibrium type, the positional relationship between the recording medium P and the belt is kept roughly constant. Therefore, it is possible that the belt surface is damaged by the recording medium, although it depends on the type (characteristics) of recording medium. For example, if thick sheets of recording medium, which are the same in width, are continuously used, it is possible that the belt surface will be damaged by the edges of the recording medium, which in turn may affect an image in terms of its post-fixation appearance.

In this embodiment, therefore, the fixing apparatus 12 of the belt type is enabled to be operated in one of the two belt deviation control modes, that is, the belt deviation control mode of the equilibrium type (which hereafter will be referred to as the first control mode), and the belt deviation control mode of the swing type (which hereafter will be referred to as the second control mode). The portion of the image forming apparatus, which operates the apparatus in one of the two modes, is the CPU 100. The CPU is provided with a portion which detects the characteristics of the sheet of recording medium P, which information is fed into the apparatus, and a mode selecting portion which selects the first or second mode in response to the recording medium characteristics detected by the portion which detects the characteristics of the sheet of recording medium. The recording medium characteristic detecting portion determines whether or not the edges of the sheet of recording medium P are likely to affect the belt. More specifically, it determines whether or not the thickness of the recording medium P exceeds a preset value. The determination making portion in this embodiment is the combination of the control portion 101, which also functions as the input portion, and the CPU 100, which is the control portion. The mode selecting portion is the CPU 100.

The CPU 100 determines the characteristics of the recording medium, based on the recording medium selection inputted by a user through the control portion 101. Then, it operates the fixing apparatus in the first or second control mode based on the recording medium characteristics it has determined.

More specifically, in this embodiment, if the recording medium used for a given image forming operation is no less than 105 gsm in basic weight, the CPU 100 operates the fixing apparatus in the second control mode (the belt deviation control mode of the swing type); it switches from the first control mode (the belt deviation control mode of the equilibrium type). That is, even though there are various recording media, as long as the recording media are no more than 105 gsm in basic weight, their edges have little effect upon the belt. Therefore, when a sheet of recording medium which is no more than 105 gsm in basic weight is used, the CPU 100 operates the fixing apparatus in the first control mode, in which the inward surface of the belt is less likely to be frictionally worn than in the second control mode, whereas when a sheet of recording medium which is no less than 105 gsm in basis weight (thicker sheet of recording medium) is used, the CPU 100 operates the fixing apparatus in the second mode, because a thicker sheet of recording medium has greater in the effect of their edges upon the belt than a thinner sheet of recording medium.

Figure 15:
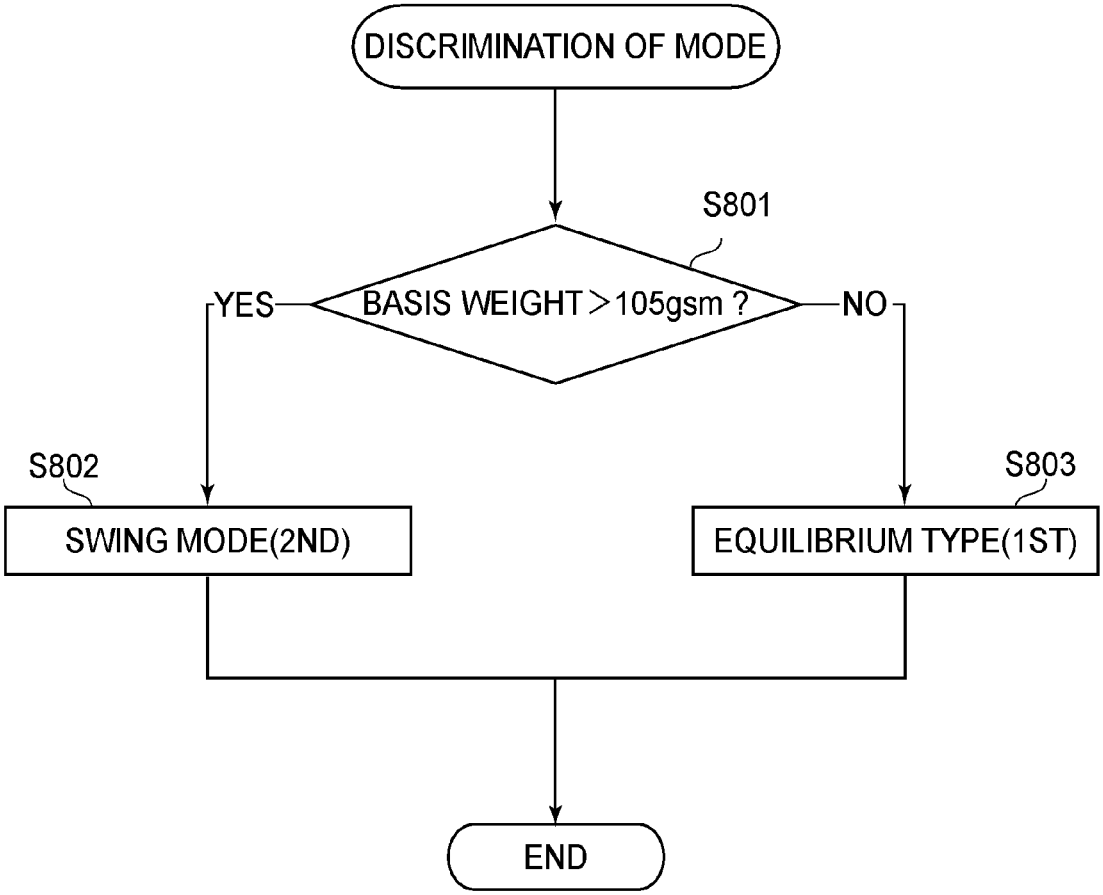
FIG. 15 is a flowchart of the operation for switching the belt deviation control mode based on the recording medium type.

FIG. 15 is the flowchart of the control sequence for switching the belt deviation control mode. First, in Step S801, it is determined whether the recording medium used for the current image forming operation is heavier in basic weight than 105 g. If the recording medium is no more than 105 g, Step S803 is performed, in which the belt deviation control mode is switched to the first control mode (the belt deviation control mode of equilibrium type). Obviously, if the image forming apparatus is already in the first control mode, it does not need to be switched in the belt deviation control mode. If the recording medium is no less than 105 g in basic weight, a step S802 is performed, in which the belt derivation control mode is switched to the second control mode (the swing type belt deviation control mode). It is also obvious that if the image forming apparatus is already in the second control mode, it does not need to be switched in the belt deviation control mode.

As described above, in this embodiment, both the belt deviation control mode of the swing type characterized in that the belt surface is less likely to be scarred by recording medium than in the belt deviation control mode of the equilibrium type, but is more likely to be worn by the friction between the belt and belt supporting shafts, and the belt deviation control mode of the equilibrium type characterized in that the belt is less likely to be worn by the friction between the belt and belt supporting shafts than in the deviation control mode of the swing type, but the belt surface is more likely to be scarred by recording medium than in the belt deviation control mode of the swing type, are used. That is, the belt deviation control mode is chosen based on the characteristic of the recording medium, which is determined by the recording medium characteristic determining portion; if the image forming apparatus is in the wrong belt deviation control mode, the belt deviation control mode of the apparatus is switched. Therefore, the fixating apparatus in this embodiment, which is of the belt type (an endless belt rotating apparatus), is significantly more durable than any of conventional fixing apparatuses of the belt type. In other words, the present invention makes it possible to provide a fixing apparatus of the belt type, which is significantly more durable, no more complicated in its fixing means, no higher in cost, and no larger than any of the conventional fixing apparatuses of the belt type.

In this embodiment, the recording medium property which is used to determine which belt deviation control mode is to be used is the basic weight of the recording medium. However, it does not need to be the basic weight of recording medium, as long as it is appropriate to determine the extent of the effect of the recording medium edges upon the belt. For example, it may be the name or the type of recording medium, or the size or the thickness of the recording medium.

Further, an image forming apparatus may be structured so that the means for detecting the characteristic(s) of recording medium is in the recording medium conveyance path of the apparatus, and the recording medium characteristic(s) is determined by inputting the information detected by the recording medium property detecting means into the CPU 100. In such a case, the CPU 100 is the portion into which the detected characteristic(s) of the recording medium is inputted.

Embodiment 2

In the first preferred embodiment, the belt deviation control mode was selected based on the type of recording media. However, it is difficult to identify all the recording media, because there are so many countries which are different in recording media type, and also, recording paper may be differently cut by individual users.

Thus, in a case where it is difficult to determine the recording medium type, the belt deviation control mode in the second embodiment, which will described next, is effective. That is, also in the second embodiment, the fixing apparatus 12 of the belt type is enabled to be operated one of the two belt deviation controlling mode, that is, the belt deviation controlling first mode (belt deviation control mode of equilibrium type) and the belt deviation controlling second mode (belt deviation control mode of swing type), as in the first embodiment. Further, the image forming apparatus is provided with a portion which determines whether or not the belt is conveying a sheet of a recording medium P, and a portion which selects the belt deviation control mode (switches between first and second control modes) based on the results of the determination made by the selecting portion. In this embodiment, the CPU 100 is made to function as both the determining portion and selecting portion.

Figure 16:
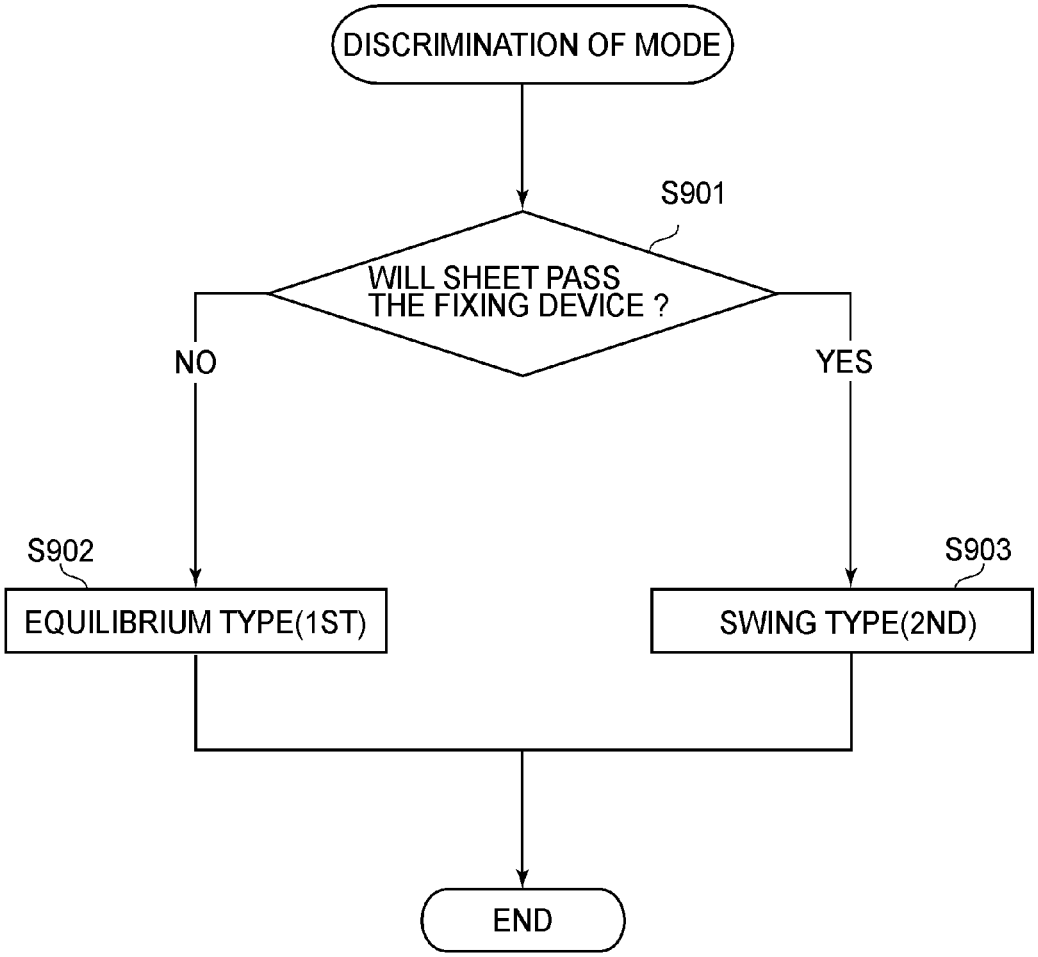
FIG. 16 is a flowchart of the operation for switching the belt deviation control mode based on the recording medium passage timing.

In this embodiment, the belt deviation control mode is selected based on the timing with which recording medium passes the fixing apparatus. Next, this sequence for selecting the belt deviation control mode will be described referring to FIG. 16, which is a flowchart of this sequence.

This sequence is carried out with preset intervals, for example, every 100 ms. First, in step S901, it is checked whether or not a sheet of a recording medium passes through the fixing apparatus (fixing device) of the belt type before the next checking time. If no recording medium passes, Step S902 is performed, in which the belt deviation control mode is switched to the first mode (the control mode of equilibrium type). If it is determined that a sheet of recording medium will pass the fixing apparatus, Step S903 is performed, in which the belt deviation control mode is switched to the second mode (the control mode of swing type). Needless to say, if the control mode, in which the fixing apparatus currently is operating, is the same as the control mode as the selected control mode, it is unnecessary to switch the control mode of the fixing apparatus. Incidentally, in this embodiment, the image forming apparatus is set up so that the second control mode is selected at least if it is determined that a sheet of a recording medium will pass the nip of the fixing apparatus.

Whether or not a sheet of a recording medium is passing through the fixing apparatus may be determined based strictly on the positional relationship between the recording medium and the belt. For example, once a sheet of the recording medium begins to pass through the fixing apparatus, it may be determined that sheets of the recording medium are passing through the fixing apparatus, until the length of time a sheet of the recording medium does not pass through the fixing apparatus lasts for a preset length of time. Instead, as soon as a preset number of sheets of recording medium passes through the fixing apparatus, or as soon as a preset length of time passes after sheets of recording medium begins to be passed through the fixing apparatus, it may be determined that sheets of the recording medium are passing.

Further, whether or not a given period is a period in which recording medium is passing through the fixing apparatus may be determined based on the answer from a computation made from: the point in time at which a sheet of a recording medium begins to be conveyed, or registered; the speed at which a recording medium is conveyed; and the length of the recording medium conveyance path. Further, it may be determined based on a signal sent from a recording medium sensor with which the fixing apparatus is provided.

That is, also in this embodiment, both the belt deviation control mode of the swing type characterized in that the belt surface is less likely to be scarred by the recording medium than in the belt deviation control mode of the equilibrium type, but is more likely to be worn by the friction between the belt and belt supporting shafts, and the belt deviation control mode of the equilibrium type characterized in that the belt is less likely to be worn by the friction between the belt and belt supporting shafts than in the deviation control mode of the swing type, but the belt surface is more likely to be scarred by recording medium than in the belt deviation control mode of the swing type, are used. Further, when the belt is conveying a sheet of a recording medium P, the fixing apparatus is operated in the belt deviation control mode of the swing type, whereas when the belt is not conveying a sheet of a recording medium P, the fixing apparatus is operated in the belt deviation control mode of the equilibrium type. Therefore, the fixating apparatus in this embodiment, which is of the belt type (an endless belt rotating apparatus), is significantly more durable than any of conventional fixing apparatuses of the belt type. In other words, the present invention makes it possible to provide a fixing apparatus of the belt type, which is significantly more durable, no more complicated, no higher in cost, and no larger than any of the conventional fixing apparatuses of the belt type.

In terms of application, the present invention, which relates to the endless belt rotating apparatus, does not need to be limited to a fixing apparatus, such as those in the above described preferred embodiments of the present invention. For example, it is also effectively applicable to a glossiness increasing apparatus, which is for increasing an image in glossiness by heating the image after the fixation of the image to a sheet of recording medium, or any endless rotating apparatus for conveying a sheet of recording medium.

The present invention makes it possible to provide a fixing apparatus, the durability of which is unlikely to be affected by the recording medium type.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 157559/2008 filed Jun. 17, 2008 which is hereby incorporated by reference.

The invention claimed is:

1. An image heating apparatus for heating an image on a recording material and said image heating apparatus comprising:

a rotatable belt member;

a pressing member configured to contact said belt member to nip and feed the recording material;

a stretching member configured to stretch said belt member;

belt position detecting means for detecting that said belt member is outside of a normal range, with respect to a perpendicular to a rotational direction of said belt member;

a device configured to determine a thickness of the recording material;

an executing portion configured to execute an equilibrium mode in which, when said belt position detecting means detects that said belt member is outside the normal range, said stretching member returns said belt member to the normal range, and when said belt member is in the normal range, said stretching member is maintained at an angle set for maintaining an equilibrium state of said belt member, and a swing mode in which, when said belt position detecting means detects that said belt member is outside the normal range adjacent one end of the normal range, said stretching member is inclined so as to shift said belt member toward the other end of the normal range, and when said belt position detecting means detects that said belt member is outside the normal range adjacent the other end of the normal range, said stretching member is inclined so as to shift said belt member toward said one end of the normal range; and a selector configured to select the equilibrium mode or the swing mode in accordance with the thickness of the recording material determined by said device.

2. An apparatus according to claim 1, wherein said selector selects the swing mode when a thickness of the recording material larger than a predetermined thickness.

3. An apparatus according to claim 1, wherein said selector selects the equilibrium mode when a thickness of the recording material is smaller than a predetermined thickness.

4. An apparatus according to claim 1, further comprising a driving member configured to stretch said belt member and transmit a driving force to said belt member.

5. An apparatus according to claim 1, wherein said pressing member includes a second belt member, and said apparatus further comprises pressing means for pressing said first belt member through said second belt member.

6. An apparatus according to claim 1, wherein in stabilizing the position of said belt member in said equilibrium mode, a stretch control operation is executed.

7. An apparatus according to claim 6, wherein in the stretch control operation, the inclination of said stretching member is set on the basis of a movement amount of said belt member relative to said stretching member.

8. An apparatus according to claim 6, wherein in said equilibrium mode, the inclination of said stretching member when said belt position detecting means does not detect said belt member is set beforehand.

9. An image heating apparatus heating an image on a recording material and said image heating apparatus comprising:

a rotatable belt member;

a pressing member configured to contact said belt member to form a heating nip for nipping and feeding the recording material;

a stretching member configured to stretch said belt member;

belt position detecting means for detecting that said belt member is outside of a normal range, with respect to a perpendicular direction to a rotational direction of said belt member;

an executing portion configured to execute an equilibrium mode in which, when said belt position detecting means detects that said belt member is outside the normal range, said stretching member returns said belt member to the normal range, and when said belt member is in the normal range, said stretching member is maintained at an angle set for maintaining an equilibrium state of said belt member, and a swing mode in which, when said belt position detecting means detects that said belt member is outside the normal range adjacent one end of the normal range, said stretching member is inclined so as to shift said belt member toward the other end of the normal range, and when said belt position detecting means detects that said belt member is outside the normal range adjacent the other end of the normal range, said stretching member is inclined so as to shift said belt member toward said one end of the normal range; and a selector configured to select the equilibrium mode when a recording material is not passing through said image heating apparatus and select the swing mode when a recording material is passing through the image heating apparatus.

10. An apparatus according to claim 9, further comprising a driving member configured to stretch said belt member and for transmitting a driving force to said belt member.

11. An apparatus according to claim 9, wherein said pressing member includes a second belt member, and said apparatus further comprises pressing means for pressing said first belt member through said second belt member.

12. An apparatus according to claim 9, further comprising recording material detecting means for detecting a thickness the recording material.

13. An apparatus according to claim 9, wherein in stabilizing the position of said belt member in the equilibrium mode, a stretch control operation is executed.

14. An apparatus according to claim 13, wherein in the stretch control operation, the inclination of said stretching member is set on the basis of a movement amount of said belt member relative to said stretching member.

15. An apparatus according to claim 9, wherein in said equilibrium mode, the inclination of said stretching member when said belt position detecting means does not detect said belt member is set beforehand.

* * * * *